US009955261B2

(12) United States Patent
Ojala et al.

(10) Patent No.: US 9,955,261 B2
(45) Date of Patent: Apr. 24, 2018

(54) METHOD AND APPARATUS FOR ADJUSTING A CROSS-OVER FREQUENCY OF A LOUDSPEAKER

(71) Applicant: VLSI Solution Oy, Tampere (FI)

(72) Inventors: Pasi Ojala, Tampere (FI); Toni Liitola, Tampere (FI)

(73) Assignee: VLSI Solution Oy, Tampere (FI)

( * ) Notice: Subject to any disclaimer, the term of this patent is extended or adjusted under 35 U.S.C. 154(b) by 0 days.

(21) Appl. No.: 15/404,835

(22) Filed: Jan. 12, 2017

(65) Prior Publication Data

US 2017/0201830 A1 Jul. 13, 2017

(30) Foreign Application Priority Data

Jan. 13, 2016 (EP) ..... 16397501

(51) Int. Cl.
*H04R 3/14* (2006.01)
*H04R 29/00* (2006.01)
(Continued)

(52) U.S. Cl.
CPC ..... *H04R 3/14* (2013.01); *H04R 3/04* (2013.01); *H04R 29/001* (2013.01);
(Continued)

(58) Field of Classification Search
CPC ..... H04R 3/14; H04R 3/04; H04R 29/001; H04R 29/002; H04R 2430/01; H04S 7/301
See application file for complete search history.

(56) References Cited

U.S. PATENT DOCUMENTS 8,082,051 B2 * 12/2011 Mihelich ..... H04S 7/301 381/303
8,559,655 B2 * 10/2013 Mihelich ..... H04S 7/301 381/103
(Continued)

FOREIGN PATENT DOCUMENTS

EP 2693721 A2 2/2014
WO 2010122441 A1 10/2010

OTHER PUBLICATIONS

"Audyssey Setup Guide." GIOMANIA, Sep. 6, 2016, Retrieved from https://web.archive.org/web/20150906030425/http://www.willowvillie.net/ht/Audyssey Setup Guide.pdf, 11 pages.
(Continued)

*Primary Examiner* — Brenda C Bernardi
(74) *Attorney, Agent, or Firm* — Ziegler IP Law Group, LLC

(57) ABSTRACT

A method and apparatus for adjusting a cross-over frequency of a loudspeaker system. The loudspeaker system includes at least a first loudspeaker for frequencies below the cross-over frequency and a second loudspeaker for frequencies above the cross-over frequency. A level of the first loudspeaker is matched with the second loudspeaker using a first test signal and a room response is compensated in the loudspeaker system on the basis of the first test signal. The compensated room response is measured using a second test signal. A maximum frequency for the first loudspeaker and a minimum frequency for the second loudspeaker are determined. A cross-over frequency that results in a minimum cumulative total harmonic distortion energy at one or more sound pressure levels is searched between the minimum and maximum frequency.

12 Claims, 3 Drawing Sheets

(51) Int. Cl.
*H04R 3/04* (2006.01)
*H04S 7/00* (2006.01)

(52) U.S. Cl.
CPC ..... *H04R 29/002* (2013.01); *H04S 7/301* (2013.01); *H04R 2430/01* (2013.01)

(56) References Cited

U.S. PATENT DOCUMENTS

| | | | | |
|---|---|---|---|---|
| 9,008,330 | B2 * | 4/2015 | Sheen | H04R 3/14 381/99 |
| 9,674,609 | B2 * | 6/2017 | Katayama | H04R 3/12 |
| 2010/0290643 | A1 | 11/2010 | Mihelich et al. | |
| 2016/0105742 | A1 * | 4/2016 | Gautama | H03G 3/20 381/99 |

OTHER PUBLICATIONS

Extended European Search Report, Application No. 16397501.4-1910, dated Apr. 21, 2016, 6 pages.

* cited by examiner

METHOD AND APPARATUS FOR ADJUSTING A CROSS-OVER FREQUENCY OF A LOUDSPEAKER

TECHNICAL FIELD

The present invention relates to a method for adjusting a cross-over frequency of a loudspeaker system, wherein the loudspeaker system comprises at least a first loudspeaker for frequencies below a cross-over frequency and a second loudspeaker for frequencies above the cross-over frequency. The present invention also relates to a loudspeaker system comprising at least a first loudspeaker for frequencies below a cross-over frequency; a second loudspeaker for frequencies above the cross-over frequency; and a channel divider for dividing an input signal into a first frequency band and a second frequency band.

BACKGROUND

Some loudspeaker systems comprise two or more loudspeakers so that a first loudspeaker is designed to operate on low frequency signals and a second loudspeaker is designed to operate on high frequency signals. The division between low and high frequency signals may be performed so that a so called cross-over frequency is determined, wherein signals having lower frequency than the cross-over frequency are considered as low frequency signals and, respectively, signals having higher frequency than the cross-over frequency are considered as high frequency signals. Hence, the loudspeaker system may comprise a channel divider which divides an input signal to two output signals in such a way that signals having frequency lower than the cross-over frequency are provided to the first loudspeaker and signals having frequency higher than the cross-over frequency are provided to the second loudspeaker. However, in practical implementations the division into low and high frequencies is not so straightforward and some overlapping may occur. In other words, loudspeakers which are designed to operate on low frequency signals have frequency response which may extend slightly over the cross-over frequency and loudspeakers which are designed to operate on high frequency signals have frequency response which may extend slightly below the cross-over frequency. It may also be possible that the loudspeaker system may have more than two loudspeakers each designed to operate on different frequency ranges.

In addition to properties of the loudspeakers there may be other factors as well which may affect the frequency response of the loudspeaker system. For example, loudspeaker casings and/or room properties may affect the listening experience of the loudspeaker system. Therefore, it may be desirable to provide a method and a loudspeaker system which is adaptable to properties of the components of the loudspeaker system and to operating environment.

Loudspeakers designed to operate on low frequency signals may also be called as woofers or subwoofers, and loudspeakers designed to operate on high frequency signals may also be called as tweeters. Loudspeaker systems having two or more loudspeakers such as one or more subwoofers and one or more tweeters may be called as two-way or multiway loudspeaker systems.

SUMMARY

It is an aim or the present invention to provide an improved method for adjusting a cross-over frequency of a loudspeaker system and a loudspeaker system.

According to a first aspect there is provided a method for adjusting a cross-over frequency of a loudspeaker system, the loudspeaker system comprising at least a first loudspeaker for frequencies below a cross-over frequency and a second loudspeaker for frequencies above the cross-over frequency, wherein the method comprises:

matching level of the first loudspeaker with the second loudspeaker using a first test signal;

compensating a room response in the loudspeaker system on the basis of the first test signal;

measuring the compensated room response using a second test signal;

determining a maximum frequency for the first loudspeaker and a minimum frequency for the second loudspeaker; and searching a cross-over frequency between the minimum and maximum frequency that results in a minimum cumulative total harmonic distortion energy at one or more sound pressure levels.

According to a second aspect there is provided an apparatus for adjusting a cross-over frequency of a loudspeaker system, the loudspeaker system comprising at least a first loudspeaker for frequencies below a cross-over frequency and a second loudspeaker for frequencies above the cross-over frequency, wherein the apparatus comprises:

means for matching level of the first loudspeaker with the second loudspeaker using a first test signal;

means for compensating a room response in the loudspeaker system;

means for measuring the compensated room response using a second test signal;

means for determining a maximum frequency for the first loudspeaker and a minimum frequency for the second loudspeaker; and means for searching a cross-over frequency between the minimum and maximum frequency that results in a minimum cumulative total harmonic distortion energy at one or more sound pressure levels.

In accordance with an embodiment, a set of measurements are performed and an algorithm is implemented which may design substantially optimal cross-over between the loudspeakers and a subwoofer system. A subwoofer system refers to a system which consist of one or more subwoofers. Based on several measurements, the method may be used to design a digital cross-over that has substantially minimum distortion across the reproduced spectrum.

In accordance with an embodiment searching the cross-over frequency between the minimum and maximum frequency is performed so that the minimum cumulative total harmonic distortion energy is achieved at one or more sound pressure levels.

DETAILED DESCRIPTION OF SOME EXAMPLE EMBODIMENTS

Figure 1:
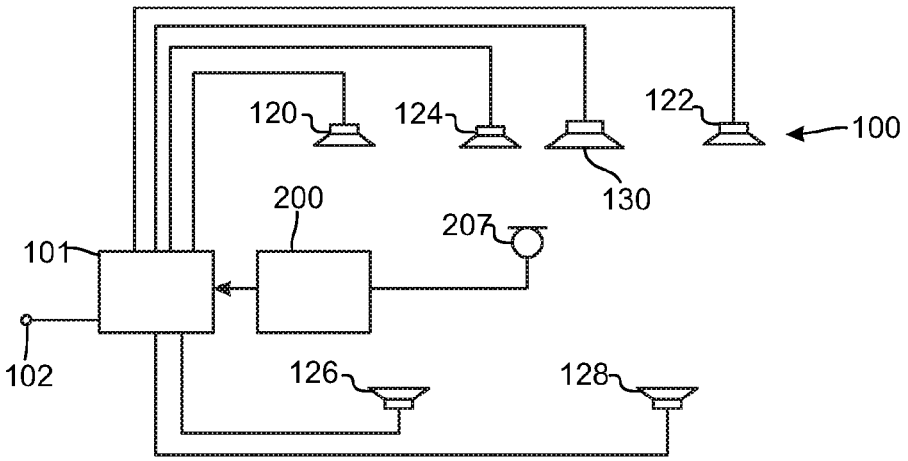
FIG. 1 depicts an example of a loudspeaker and measurement system, in accordance with an embodiment.

In the following, an example of a loudspeaker system 100 and a measurement system 200 is described with reference to FIGS. 1 and 2. The loudspeaker system 100 of FIG. 1 comprises a first loudspeaker system and a second loudspeaker system. The first loudspeaker system may comprise one or more so called subwoofers 130 intended to operate on very low frequencies. The second loudspeaker system may comprise one or more loudspeakers 120-128 intended to operate mainly on higher frequencies than the subwoofer 130. In accordance with an embodiment, the second loudspeaker system may comprise a front-left loudspeaker 120, a front-right loudspeaker 122, a front-centre loudspeaker 124, a back-left loudspeaker 126, and a back-right loudspeaker 128. The loudspeaker system 100 also comprises an equalizer 101 for dividing an input audio signal to different frequency bands and for providing the frequency bands to appropriate loudspeakers 130, 120-128. As an example, the equalizer 101 may provide very low frequency signals to the subwoofer 130 and signals having higher frequencies to the other loudspeakers 120-128. Furthermore, the equalizer 101 or another element of the loudspeaker system 100 may perform stereo separation of the incoming audio signal so that left channel signals are provided to the left side loudspeakers 120, 126 and right channel signals are provided to the right side loudspeakers 122, 128. The front-centre loudspeaker 124 may be provided, for example, with a part of low frequencies, for example frequencies above 40 Hz and below 1 kHz. The subwoofer 130 may be provided, for example, with a part of lowest frequencies, for example frequencies above 20 Hz and below 200 Hz or even with a narrower frequency range such as 20-100 Hz or 20-80 Hz.

Figure 2:
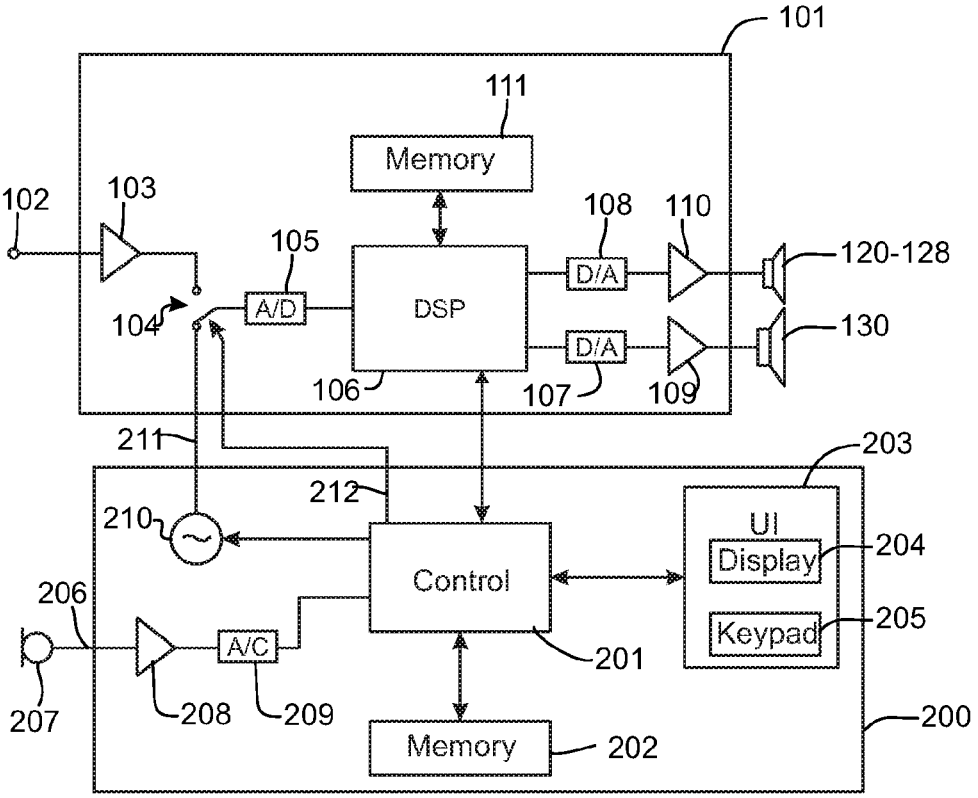
FIG. 2 depicts as a block diagram the loudspeaker and measurement system of FIG. 1, in accordance with an embodiment.

It should be noted here that although the subwoofer 130 and the loudspeakers 120-128 are depicted in FIGS. 1 and 2 as single loudspeaker elements, they may comprise more than one loudspeaker element and also a frequency divider (not shown). For example, the loudspeakers 120-128 may comprise one or more loudspeakers for lower frequencies (a bass loudspeaker) and one or more other loudspeakers for higher frequencies (a tweeter loudspeaker). Hence, each of the loudspeakers 120-128 may be able to reproduce audio signals on a human hearing range.

In FIG. 2 the loudspeaker system 100 and the measurement system 200 of FIG. 1 are depicted as a more detailed block diagram. The equalizer 101 may comprise an audio input 102 for receiving audio signals in analogue form. These audio signals may be amplified by a first amplifier 103. Hence, the amplified analogue signals may be connected to a first analogue-to-digital converter 105 (A/D, ADC) e.g. via a switch 104. The first analogue-to-digital converter 105 converts the analogue signals into digital form e.g. by taking samples of the analogue signals. Values of the samples represent amplitude of the analogue signal at the sampling moments. The samples are provided to a digital signal processor 106 (DSP) for further processing, as will be described later. The digital signal processor 106 may produce digital signals at different frequency bands on the basis of the received samples. In other words, the digital signal processor 106 may have computer code to operate as a cross-over network. As an example, the digital signal processor 106 may produce a first digital output to a first digital-to-analogue converter 107 (D/A, DAC) and a second digital output to a second digital-to-analogue converter 108. The first digital output may include a frequency band for the subwoofer 130 and the second digital output may include a frequency band for other loudspeakers 120-128. The output of the first digital-to-analogue converter 107 may be amplified by a second amplifier 109 and the output of the second digital-to-analogue converter 108 may be amplified by a third amplifier 110. In practice, there may be several outputs from the digital signal processor 106, several second digital-to-analogue converters 108, and several third amplifiers 110 for different loudspeakers 120-128 of the loudspeaker system 100. The loudspeaker system 100 may further comprise a memory 111 for storing data and computer code for the digital signal processor 106.

The measurement system 200 of FIG. 2 comprises a processor 201 for controlling the operation of the measurement system 200, a memory 202 for storing data and computer code for the processor 201, and a user interface 203 for interacting with a user of the measurement system 200. The user interface 203 may comprise a display 204 for displaying information and a keyboard 205 for receiving information from the user. the measurement system 200 may further comprise an audio input 206 for receiving analogue signals e.g. from a microphone 207, a fourth amplifier 208 for amplifying the analogue signals, and a second analogue-to-digital converter 209 for converting the analogue signals into digital samples. The measurement system 200 may further comprise a signal generator 210 for generating analogue signals for measurement and adjustment of the loudspeaker system 100. However, the operations of the signal generator 210 may be implemented e.g. in the digital signal processor 106 of the equalizer 101. As another alternative, the processor 201 may produce digital information representing a desired audio signal, wherein the measurement system may comprise a digital-to-analogue converter (not shown) to convert the digital information into analogue signal to be provided to the equalizer 101.

In the following, the operation of the measurement system 200 and the loudspeaker system 100 of FIGS. 1 and 2 will be provided in more detail. The processor 201 of the measurement system 200 may control the switch 104 of the loudspeaker system 100 to a position in which a test signal from the signal generator 210 via the signal line 211 is coupled to the first analogue-to-digital converter 105. The processor 201 may further inform the digital signal processor 106 of the equalizer 101 that a measurement and adjustment process will be performed. The processor 201 may control the signal generator 210 to produce the test signal (e.g. a sine wave) so that the frequency of the signal sweeps from a first frequency to a second frequency at an appropriate pace. For example, the first frequency is the lowest frequency to be used in the process and the second frequency is the highest frequency to be used in the process, or vice versa. Some non-limiting examples of the frequency range defined by the first and second frequency are 20 Hz-20 kHz, 20 Hz-1 kHz, 20 Hz-500 Hz, 15 Hz-15 kHz, 15 Hz-1 kHz, 15 Hz-500 Hz, but also other frequency ranges may be used. The sweeping of the frequency range may be performed in such a way that the frequency increases logarithmically rather than linearly. The above described test signal is only one example of possible test signals. As another example, an impulse type of test signal may be generated. It may also be possible that different test signals and/or their combinations may be used in the measurement and adjustment process.

The values of the digital samples are indicative of the amplitude of the audible signals. Therefore, a frequency response of the loudspeaker system 100 may be obtained by measuring the amplitude of the audible signal at different frequencies. The digital signal processor 106 is aware of the frequency of the output signal at a time wherein the digital signal processor 106 may use the frequency information and the amplitude information to deduce the frequency response of the loudspeaker system 100.

The first analogue-to-digital converter 105 takes samples of the test signal and provides the samples to the digital signal processor 106. Samples should be taken at a pace equal to or higher than the highest frequency of the test signal to fulfil the so called Nyquist criterion. In other words, the sampling rate should be at least twice the highest frequency of the test signal to prevent aliasing. The sample values may be stored into the memory 111 of the digital signal processor 106 to be used in the measurement and adjustment process.

In accordance with an embodiment, the test signal may be generated directly in a digital form wherein the analogue to digital conversion of the test signal is not needed but the digital signal processor 106 may directly use the digital values of the test signal.

A filtering operation is performed to the test signal by the digital signal processor 106 so that when the frequency of the test signal is within a frequency range of the subwoofer 130, the signal is provided to the first digital-to-analogue converter 107 for forming a corresponding audio signal to be amplified by the second amplifier 109. The amplified signal is output to the subwoofer 130. Correspondingly, when the frequency of the test signal is within a frequency range of another loudspeaker 120-128, the signal is provided to the second digital-to-analogue filter 108 for forming a corresponding audio signal to be amplified by the third amplifier 110 and for outputting to said another loudspeaker 120-128. As was mentioned above, FIG. 2 only depicts the first digital-to-analogue converter 107 and the second digital-to-analogue converter 108, but there may be more than one second digital-to-analogue converter 108 for different loudspeakers 120-128. In other words, the digital signal processor 106 operates as a cross-over network including one or more low-pass filters, one or more band-pass filters and/or one or more high-pass filters so that the input signal can be divided to the subwoofer 130 and/or other loudspeaker(s) 120-128 on the basis of the frequency of the test signal.

As a result of the above described operation, the test signal is converted to audible signal (acoustic signal, sound) by one or more of the subwoofer system and the loudspeaker system.

Generated sound signal is received by the microphone 207, which converts the acoustic signal into electrical (analogue) audio signal. The audio signal may be amplified by the fourth amplifier 208 of the measurement system 200 and converted into digital samples by the second analogue-to-digital converter 209 of the measurement system 200. The processor 201 reads the samples and uses them in the measurement and adjustment process.

Figure 3:
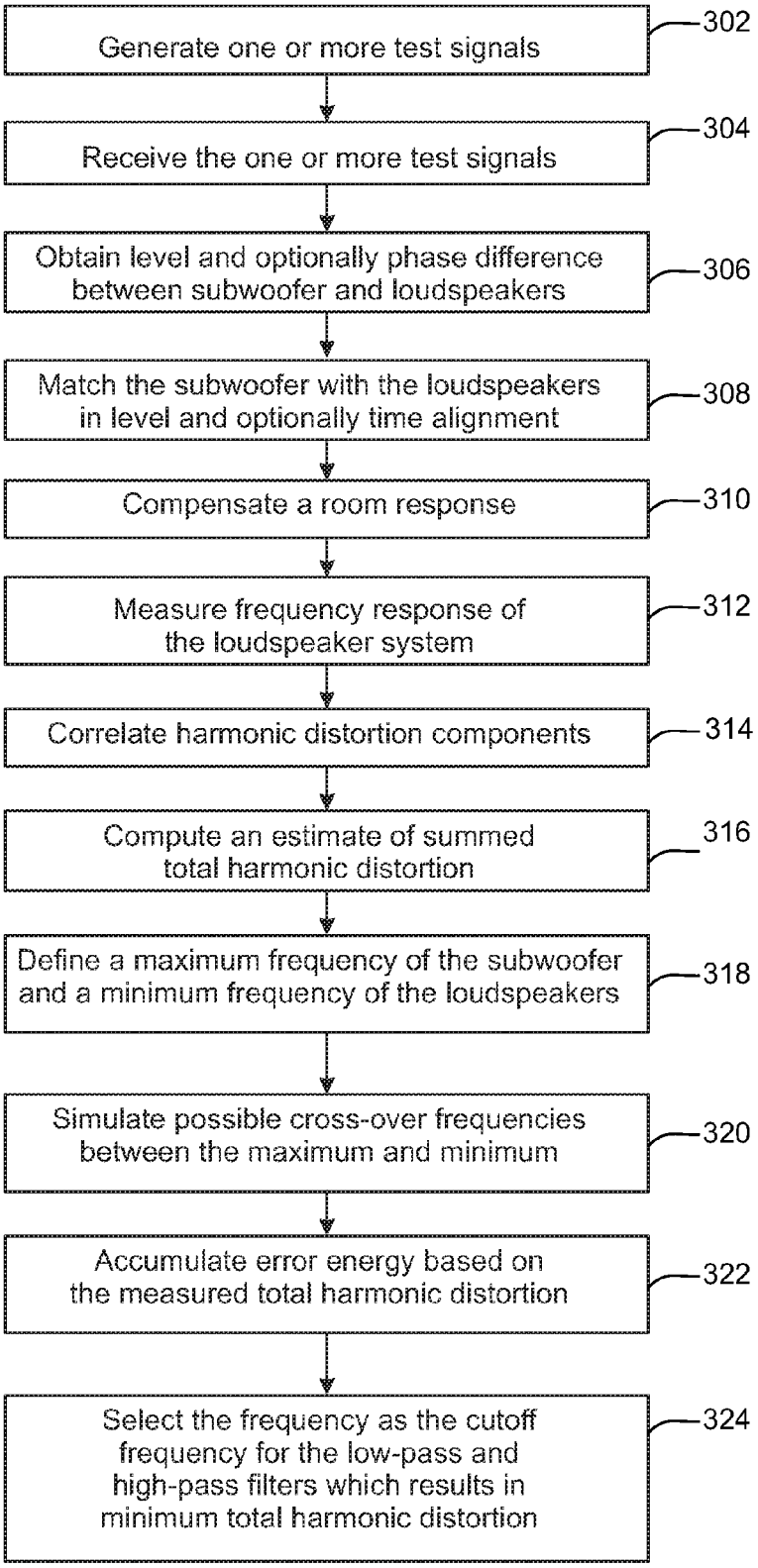
FIG. 3 depicts as a flow diagram an example of a method, in accordance with an embodiment.

In the following, a process for adjusting a cross-over frequency of the first loudspeaker system (e.g. the subwoofer 130) and the second loudspeaker system (e.g. the loudspeakers 120-128) will be described with reference to the flow diagram of FIG. 3. The test signal is generated (block 302 in FIG. 3) and the resulting sound is received (block 304) by the microphone and analysed by the digital signal processor 106 using an algorithm. The algorithm may first measure the level and optionally the phase of the loudspeakers and the subwoofer system (block 306). The measured level value and optionally the phase value are then used to match the subwoofer with the loudspeaker system in level and optionally time alignment (block 308). A room response may also be compensated in the loudspeaker system 100 on the basis of the test signal (block 310).

Figure 4A:
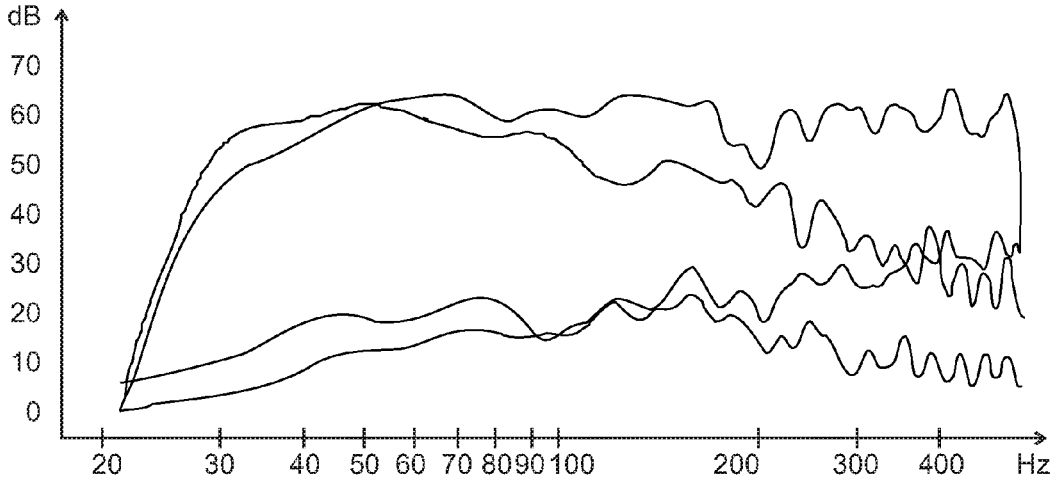
FIGS. 4*a*-4*b* depict some examples of frequency responses of the loudspeaker system, in accordance with an embodiment.
Figure 4B:
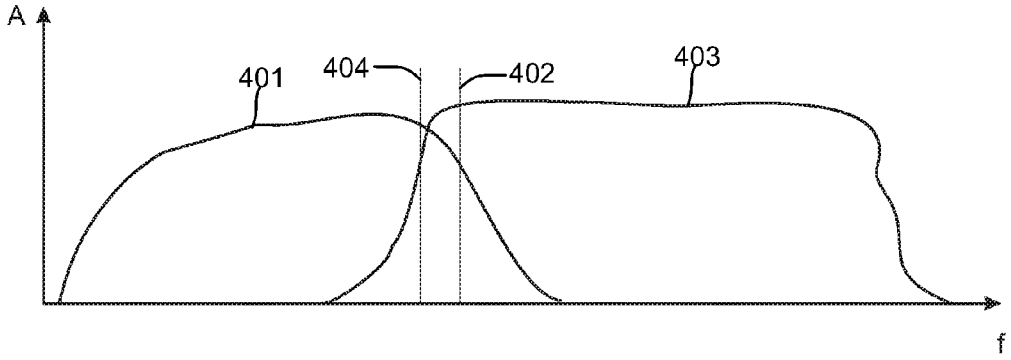

In the next phase frequency response may be measured using e.g. an IQ correlation sweep (block 312). Within the pickup of the IQ correlation, also harmonic distortion components may be correlated (block 314) and an estimate of summed total harmonic distortion may be computed using the digital signal processor 106 to obtain room responses (block 316). The measured room responses are first corrected using an automatic room-correction algorithm such as Anti-Mode or another appropriate algorithm. The algorithm may then define a maximum frequency for the subwoofer 130 and a minimum frequency for the loudspeakers 120-128 using the room-corrected frequency responses (block 318). These may be based on the linear magnitude spectrum. These points are based on natural roll-off points such as −6 dB or −3 dB points within the frequency response ends. In the measurement phase, a single or multiple points can be used for either local or global optimization. FIG. 4*b* illustrates an example of frequency responses of the subwoofer 401 and loudspeaker system 403 and the maximum frequency 402 for the subwoofer 130 and a minimum frequency 404 for the loudspeakers 120-128.

In the next phase, the digital signal processor 106 simulates every possible cross-over frequency that can be placed between these points (block 320), and accumulates the error energy based on the measured total harmonic distortion (block 322). The digital signal processor 106 then chooses the frequency that results in the minimum cumulative total harmonic distortion energy. This frequency is then chosen as a cutoff frequency for the digital low-pass filter for the subwoofer 130, and as a cutoff frequency for the digital high-pass filter for the loudspeakers 120-128 (block 324).

It should be mentioned here that the terms low frequency and high frequency may not necessarily mean certain frequency ranges but they are related to the cross-over frequency (a.k.a. the cutoff frequency). In other words, low frequencies are mainly frequencies below the cross-over frequency and high frequencies are mainly frequencies above the cross-over frequency. However, as was mentioned earlier, there is no strict limit between low frequencies and high frequencies but there may be an overlapping region around the cross-over frequency. Moreover, the cross-over frequency may be adjustable, wherein both the low frequency band and high frequency band may also be adjustable according to measurements.

When the level and optional phase difference measurements as well as the room correction measurements are performed, the microphone 207 may be positioned at an assumed listening position in the room. The measurements may also be repeated several times keeping the microphone 207 at the same location or placing the microphone 207 at different locations for different measurement runs.

In accordance with an embodiment, the sound pressure level of the audio signals provided to the loudspeaker system 100 during the test may be set to a level which corresponds with a normal listening level.

In accordance with an embodiment, the processor 210 and/or the digital signal processor 106 may perform the measurement of the subwoofer and loudspeaker system one at a time as follows. The processor 210 or the digital signal processor 106 selects the subwoofer 130 or one loudspeaker 120-128 of the loudspeaker system for measurement. Then the test signal is generated and provided through the filters of the digital signal processor 106. The filtered test signal is only connected to the selected element, namely to the subwoofer 130 or one loudspeaker 120-128 and the microphone 207 is used to receive the sound signal generated by the selected element 130, 120-128. The measurement results are stored into the memory 111 and another element of the subwoofer and loudspeaker system is selected for measurement. The procedure above is repeated until each element have been tested. In this embodiment, the test signal need not sweep each time the whole frequency range but may sweep only an appropriate section of the frequency range. For example, when the subwoofer 130 is selected for measurement, the test signal may sweep only low frequencies, such as 15-200 Hz.

In accordance with another embodiment, the processor 210 and/or the digital signal processor 106 may perform the measurement so that one test sequence is performed using only the subwoofer system and another test sequence is performed using the loudspeaker system. In other words, when the loudspeaker system is measured, the filtered test signal is coupled to each loudspeaker 120-128 of the loudspeaker system but not to the subwoofer(s) 130.

In the following some examples will be provided.

According to a first example there is provided a method for adjusting a cross-over frequency of a loudspeaker system, the loudspeaker system comprising at least a first loudspeaker for frequencies below the cross-over frequency and a second loudspeaker for frequencies above the cross-over frequency, wherein the method comprises:

matching a level of the first loudspeaker with the second loudspeaker using a first test signal;

obtaining a room response on the basis of the first test signal by:

sweeping a frequency range of the first test signal;

providing the test signal to the first loudspeaker and the second loudspeaker to produce audible signals sweeping the frequency range;

receiving the audible signals; and computing an estimate of summed total harmonic distortion on the basis of the received signals;

compensating the room response in the loudspeaker system;

measuring the compensated room response using a second test signal;

determining a maximum frequency for the first loudspeaker by examining a frequency response of the first loudspeaker and determining a roll-off point of the first loudspeaker;

determining a minimum frequency for the second loudspeaker by examining a frequency response of the second loudspeaker and determining a roll-off point of the second loudspeaker; and searching a cross-over frequency between the minimum and maximum frequency that results in a minimum cumulative total harmonic distortion energy at one or more sound pressure levels by simulating a number of frequencies between the minimum and maximum frequency and measuring the cumulative total harmonic distortion energy at each of the frequencies.

In some embodiments the method further comprises adjusting the frequency response of the loudspeaker system to compensate the room response.

In some embodiments of the method matching the level comprises:

generating the first test signal;

providing the first test signal to the loudspeaker system to form a first acoustic signal;

receiving the first acoustic signal by a microphone to form a first electric response signal;

using the first electric response signal to obtain level information of the loudspeaker system; and wherein the method further comprises adjusting the level of at least one of the first loudspeaker and the second loudspeaker.

In some embodiments of the method matching the level comprises:

generating the first test signal;

providing the first test signal to the loudspeaker system to form a first acoustic signal;

receiving the first acoustic signal by a microphone to form a first electric response signal;

using the first electric response signal to obtain level and phase information of the loudspeaker system; and wherein the method further comprises adjusting the level and phase of at least one of the first loudspeaker and the second loudspeaker.

In some embodiments of the method measuring the compensated room response comprises:

generating the second test signal;

providing the second test signal to the loudspeaker system to form a second acoustic signal;

receiving the second acoustic signal by a microphone to form a second electric response signal; and using the second electric response signal to obtain frequency response of the loudspeaker system.

According to a second example there is provided an apparatus configured to adjust a cross-over frequency of a loudspeaker system, the loudspeaker system comprising at least a first loudspeaker for frequencies below the cross-over frequency and a second loudspeaker for frequencies above the cross-over frequency, wherein the apparatus comprises:

a signal generator configured to generate a first test signal;

a level adjustment element configured to match a level of the first loudspeaker with the second loudspeaker by using the first test signal:

a room response analysing element configured to obtain a room response on the basis of the first test signal by:

sweeping a frequency range of the first test signal;

providing the test signal to the first loudspeaker and the second loudspeaker to produce audible signals sweeping the frequency range;

receiving the audible signals; and computing an estimate of summed total harmonic distortion on the basis of the received signals a compensating element configured to compensate the room response in the loudspeaker system on the basis of the first test signal;

wherein the signal generator is further configured to generate a second test signal; and the room response analysing element is further configured to obtain a compensated room response using the second test signal;

wherein the apparatus further comprises:

a frequency determination element for determining a maximum frequency for the first loudspeaker and a minimum frequency for the second loudspeaker, wherein the frequency determination element is configured to:

examine a frequency response of the first loudspeaker;

examine a frequency response of the second loudspeaker;

searching a roll-off point of the first loudspeaker representing the maximum frequency;

searching a roll-off point of the second loudspeaker representing the minimum frequency;

a cross-over frequency determination element configured to find a cross-over frequency between the minimum and maximum frequency that results in a minimum cumulative total harmonic distortion energy at one or more sound pressure levels by simulating a number of frequencies between the minimum and maximum frequency and measuring the cumulative total harmonic distortion energy at each of the frequencies.

In some embodiments the apparatus is further configured to adjust the frequency response of the loudspeaker system to compensate the room response.

According to a third example there is provided an apparatus for adjusting a cross-over frequency of a loudspeaker system, the loudspeaker system comprising at least a first loudspeaker for frequencies below the cross-over frequency and a second loudspeaker for frequencies above the cross-over frequency, wherein the apparatus comprises:

means for matching level of the first loudspeaker with the second loudspeaker using a first test signal;

means for compensating a room response in the loudspeaker system on the basis of the first test signal;

means for measuring the compensated room response using a second test signal;

means for determining a maximum frequency for the first loudspeaker and a minimum frequency for the second loudspeaker; and means for searching a cross-over frequency between the minimum and maximum frequency that results in a minimum cumulative total harmonic distortion energy at one or more sound pressure levels.

In some embodiments the apparatus further comprises means for adjusting the frequency response of the loudspeaker system to compensate the room response.

In some embodiments of the apparatus the means for matching level comprises:

means for generating the first test signal;

means for providing the first test signal to the loudspeaker system to form a first acoustic signal;

means for receiving the first acoustic signal by a microphone to form a first electric response signal; and means for using the first electric response signal to obtain level information of the loudspeaker system;

wherein the apparatus further comprises means for adjusting the level of at least one of the first loudspeaker and the second loudspeaker.

In some embodiments of the apparatus the means for matching level comprises:

generating the first test signal;

providing the first test signal to the loudspeaker system to form a first acoustic signal;

receiving the first acoustic signal by a microphone to form a first electric response signal; and using the first electric response signal to obtain level and phase information of the loudspeaker system;

wherein the apparatus further comprises means for adjusting the level and phase of at least one of the first loudspeaker and the second loudspeaker.

In some embodiments the means for measuring the compensated room response comprises:

means for generating the second test signal;

means for providing the second test signal to the loudspeaker system to form a second acoustic signal;

means for receiving the second acoustic signal by a microphone to form a second electric response signal; and means for using the second electric response signal to obtain frequency response of the loudspeaker system.

It should be noted that the above described embodiments are only illustrative examples, but the invention can be modified within the scope of the appended claims.

We claim:

1. A method for adjusting a cross-over frequency of a loudspeaker system, the loudspeaker system comprising at least a first loudspeaker for frequencies below the cross-over frequency and a second loudspeaker for frequencies above the cross-over frequency, wherein the method comprises:

matching a level of the first loudspeaker with the second loudspeaker using a first test signal;

obtaining a room response on the basis of the first test signal by:

sweeping a frequency range of the first test signal;

providing the first test signal to the first loudspeaker and the second loudspeaker to produce audible signals sweeping the frequency range;

receiving the audible signals; and computing an estimate of summed total harmonic distortion on the basis of the received signals;

compensating the room response in the loudspeaker system;

measuring the compensated room response using a second test signal;

determining a maximum frequency for the first loudspeaker by examining a frequency response of the first loudspeaker and determining a roll-off point of the first loudspeaker;

determining a minimum frequency for the second loudspeaker by examining a frequency response of the second loudspeaker and determining a roll-off point of the second loudspeaker; and searching a cross-over frequency between the minimum and maximum frequency that results in a minimum cumulative total harmonic distortion energy at one or more sound pressure levels by simulating a number of frequencies between the minimum and maximum frequency and measuring the cumulative total harmonic distortion energy at each of the frequencies.

2. The method according to claim 1 further comprising adjusting the frequency response of the loudspeaker system to compensate the room response.

3. The method according to claim 1, wherein the matching level comprises:

generating the first test signal;

providing the first test signal to the loudspeaker system to form a first acoustic signal;

receiving the first acoustic signal by a microphone to form a first electric response signal;

using the first electric response signal to obtain level information of the loudspeaker system; and wherein the method further comprises adjusting the level of at least one of the first loudspeaker and the second loudspeaker.

4. The method according to claim 1, wherein the matching level comprises:

generating the first test signal;

providing the first test signal to the loudspeaker system to form a first acoustic signal;

receiving the first acoustic signal by a microphone to form a first electric response signal;

using the first electric response signal to obtain level and phase information of the loudspeaker system; and wherein the method further comprises adjusting the level and phase of at least one of the first loudspeaker and the second loudspeaker.

5. The method according to claim 1, wherein the measuring the compensated room response comprises:

generating the second test signal;

providing the second test signal to the loudspeaker system to form a second acoustic signal;

receiving the second acoustic signal by a microphone to form a second electric response signal; and using the second electric response signal to obtain frequency response of the loudspeaker system.

6. An apparatus configured to adjust a cross-over frequency of a loudspeaker system, the loudspeaker system comprising at least a first loudspeaker for frequencies below the cross-over frequency and a second loudspeaker for frequencies above the cross-over frequency, wherein the apparatus comprises:

a signal generator configured to generate a first test signal;

a level adjustment element configured to match a level of the first loudspeaker with the second loudspeaker by using the first test signal:

a room response analysing element configured to obtain a room response on the basis of the first test signal by:

sweeping a frequency range of the first test signal;

providing the first test signal to the first loudspeaker and the second loudspeaker to produce audible signals sweeping the frequency range;

receiving the audible signals; and computing an estimate of summed total harmonic distortion on the basis of the received signals;

a compensating element configured to compensate the room response in the loudspeaker system on the basis of the first test signal;

wherein the signal generator is further configured to generate a second test signal; and the room response analysing element is further configured to obtain a compensated room response using the second test signal;

wherein the apparatus further comprises:

a frequency determination element for determining a maximum frequency for the first loudspeaker and a minimum frequency for the second loudspeaker, wherein the frequency determination element is configured to:

examine a frequency response of the first loudspeaker;

examine a frequency response of the second loudspeaker;

searching a roll-off point of the first loudspeaker representing the maximum frequency;

searching a roll-off point of the second loudspeaker representing the minimum frequency;

a cross-over frequency determination element configured to find a cross-over frequency between the minimum and maximum frequency that results in a minimum cumulative total harmonic distortion energy at one or more sound pressure levels by simulating a number of frequencies between the minimum and maximum frequency and measuring the cumulative total harmonic distortion energy at each of the frequencies.

7. The apparatus according to claim 6, wherein the apparatus is further configured to adjust the frequency response of the loudspeaker system to compensate the room response.

8. An apparatus for adjusting a cross-over frequency of a loudspeaker system, the loudspeaker system comprising at least a first loudspeaker for frequencies below the cross-over frequency and a second loudspeaker for frequencies above the cross-over frequency, wherein the apparatus comprises:

means for matching a level of the first loudspeaker with the second loudspeaker using a first test signal configured to:

obtain a room response on the basis of the first test signal by:

sweep a frequency range of the first test signal;

provide the first test signal to the first loudspeaker and the second loudspeaker to produce audible signals sweeping the frequency range;

receive the audible signals; and compute an estimate of summed total harmonic distortion on the basis of the received signals means for compensating a room response in the loudspeaker system on the basis of the first test signal;

means for measuring the compensated room response using a second test signal;

means for determining a maximum frequency for the first loudspeaker by examining a frequency response of the first loudspeaker and determining a roll-off point of the first loudspeaker;

means for determining a minimum frequency for the second loudspeaker by examining a frequency response of the second loudspeaker and determining a roll-off point of the second loudspeaker; and means for searching a cross-over frequency between the minimum and maximum frequency that results in a minimum cumulative total harmonic distortion energy at one or more sound pressure levels by simulating a number of frequencies between the minimum and maximum frequency and measuring the cumulative total harmonic distortion energy at each of the frequencies.

9. The apparatus according to claim 8, wherein the apparatus further comprises means for adjusting the frequency response of the loudspeaker system to compensate the room response.

10. The apparatus according to claim 8, wherein the means for matching the level of the first loudspeaker with the second loudspeaker comprises:

means for generating the first test signal;

means for providing the first test signal to the loudspeaker system to form a first acoustic signal;

means for receiving the first acoustic signal by a microphone to form a first electric response signal; and means for using the first electric response signal to obtain level information of the loudspeaker system;

wherein the apparatus further comprises means for adjusting the level of at least one of the first loudspeaker and the second loudspeaker.

11. The apparatus according to claim 8, wherein the means for matching the level of the first loudspeaker with the second loudspeaker comprises:

generating the first test signal;

providing the first test signal to the loudspeaker system to form a first acoustic signal;

receiving the first acoustic signal by a microphone to form a first electric response signal; and using the first electric response signal to obtain level and phase information of the loudspeaker system;

wherein the apparatus further comprises means for adjusting the level and phase of at least one of the first loudspeaker and the second loudspeaker.

12. The apparatus according to claim 8, wherein the means for measuring the compensated room response comprises:

means for generating the second test signal;

means for providing the second test signal to the loudspeaker system to form a second acoustic signal;

means for receiving the second acoustic signal by a microphone to form a second electric response signal; and means for using the second electric response signal to obtain frequency response of the loudspeaker system.

* * * * *